US005125305A

United States Patent [19]

Morrison et al.

[11] Patent Number: 5,125,305

[45] Date of Patent: Jun. 30, 1992

[54] APPARATUS AND METHOD FOR CUTTING SLABS FROM A FROZEN FISH BLOCK

[75] Inventors: Clifton H. Morrison, St. Paul; Gerald J. Elander, Brooklyn Park; Stanley C. Rustad, Waconia, all of Minn.; John T. Lyons, East Aurora, N.Y.

[73] Assignee: General Mills, Inc., Minneapolis, Minn.

[21] Appl. No.: 581,932

[22] Filed: Sep. 13, 1990

[51] Int. Cl.[5] ..... B26D 7/06

[52] U.S. Cl. ..... 83/160; 83/278; 83/356.2; 83/409.2; 83/460

[58] Field of Search ..... 83/409, 409.2, 703, 83/707, 417, 406.1, 109, 160, 278, 356.2, 460

[56] References Cited

U.S. PATENT DOCUMENTS

| | | | |
|---|---|---|---|
| 3,702,150 | 11/1972 | Müller et al. | 83/707 |
| 3,736,829 | 6/1973 | Pedi | 83/703 |
| 4,050,339 | 9/1977 | Soleri | 83/703 |
| 4,112,834 | 9/1978 | Thiry | 83/406.1 |
| 4,299,150 | 11/1981 | Huston et al. | 83/409 |
| 4,463,643 | 8/1984 | Bettcher | 83/703 |
| 4,552,049 | 11/1985 | Matzinger et al. | 83/417 |
| 4,644,729 | 2/1987 | Fessler | 83/417 |

*Primary Examiner*—Douglas D. Watts
*Assistant Examiner*—Scott A. Smith
*Attorney, Agent, or Firm*—L. MeRoy Lillehaugen; John A. O'Toole

[57] ABSTRACT

The disclosed apparatus includes a magazine for containing a plurality of frozen blocks of fish therein, the lower surfaces of the blocks resting on a table that is vertically adjustable relative to a reciprocable blade. A pusher unit is provided for each of the plurality of blocks, the pusher units ejecting the cut slabs each time the blade is retracted after completing a cutting stroke. During the cutting stroke the blocks are securely clamped.

6 Claims, 10 Drawing Sheets

APPARATUS AND METHOD FOR CUTTING SLABS FROM A FROZEN FISH BLOCK

BACKGROUND OF THE INVENTION

1. Field of the Invention

This invention relates generally to the cutting of frozen food, and pertains more particularly to a method and apparatus for cutting slabs of a desired thickness from a frozen fish block or the like.

2. Description of the Prior Art

U.S. Pat. No. 4,299,150, issued on Nov. 10, 1981 to Huston et al, for "METHOD AND APPARATUS FOR SEVERING PORTIONS FROM A PLURALITY OF FROZEN COLUMNS OF FISH OR THE LIKE," has recognized the problem of sawing blocks of frozen fish, usually referred to as logs or columns, into smaller portions in that the sawing action produces an objectionable amount of "sawdust" which reduces the yield that would otherwise be obtained if the portions were all intact. Hence, a reciprocable knife blade in said patent cuts off the lower portions of the logs or columns without the production of sawdust, although some sawdust has initially resulted in that the logs or columns have been typically cut from larger blocks by means of a band saw. Such smaller portions, as explained in the alluded to patent, are dimensioned so as to be suitable for delivery to a breading and battering station.

While the apparatus described in Patent '150 has satisfactorily cut the majority of the portions to a generally desired thickness, the need for apparatus that will cut relatively large slabs from even larger blocks of frozen fish exists.

SUMMARY OF THE INVENTION

An important object of the invention is to provide sufficiently rugged apparatus so that sizeable slabs can be accurately cut from blocks of frozen food, such as frozen fish blocks.

Another object is to provide apparatus that will cut frozen food blocks into individual slabs which is relatively simple and reliable so that production downtime is minimized.

Another object of the invention is to produce slabs having a specified thickness, at least generally so, that can subsequently be easily cut into individual smaller pieces.

Yet another object of the invention is to sever slabs from the lower portions of much larger frozen fish blocks, doing so in a semi-automatic manner. In this regard, it is planned that five blocks be inserted downwardly in a magazine and that the blocks be first formed so that all five blocks have substantially the same height. After doing this, each block is automatically clamped and cut (while clamped) into slabs having a general proportional relationship to the height of the blocks. Should the thickness of the slabs being cut deviate sufficiently from a desired thickness, a motorized means enables the operator to make a quick adjustment of the table height, either up or down, to provide slabs of a desired thickness.

Briefly, our invention contemplates positioning a desired number of frozen fish blocks in a magazine, the magazine having five vertically oriented compartments. The lower ends of the various blocks rest on a vertically adjustable support table. A reciprocable knife blade advances to cut off slabs from the lower end portions of the various frozen fish blocks, and after being severed, pushers simultaneously move the slabs onto a conveyer belt. The height of the support table is adjusted via a motorized system, when necessary, to produce a desired thickness of the slabs. During a cutting operation the frozen fish blocks are securely clamped so that a precision cut of slabs from the lower portions of the frozen blocks can be realized. The clamping action is automatically initiated before each cutting stroke.

BRIEF DESCRIPTION OF THE DRAWINGS

FIG. 6 is a top plan view of the apparatus shown in FIG. 1, but with a portion of the conveyer also illustrated;

DESCRIPTION OF THE PREFERRED EMBODIMENT

Figure 1:
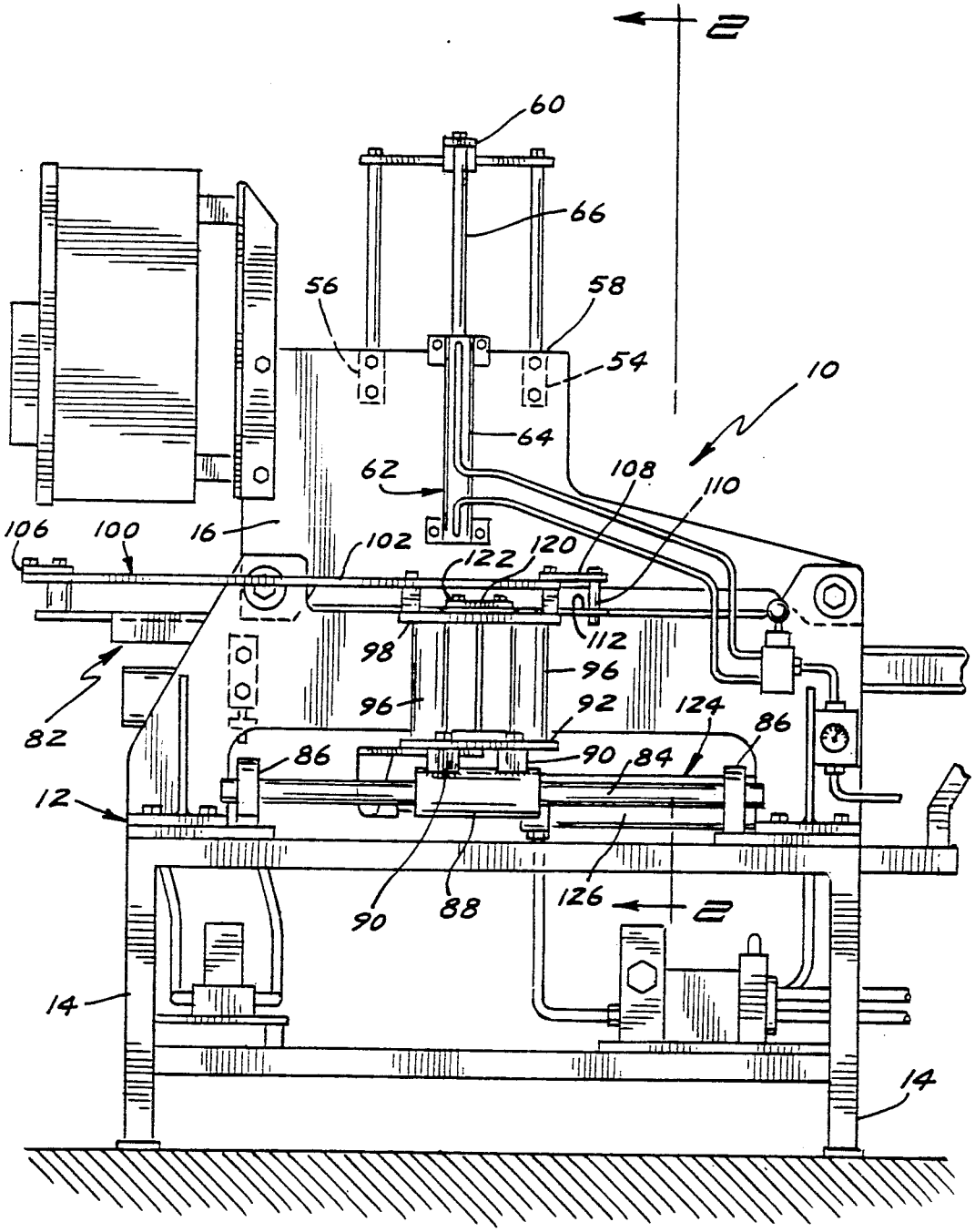
FIG. 1 is a side elevational view of apparatus exemplifying our invention, the conveyer portion of the apparatus having been omitted because of scale limitations.
Figure 2:
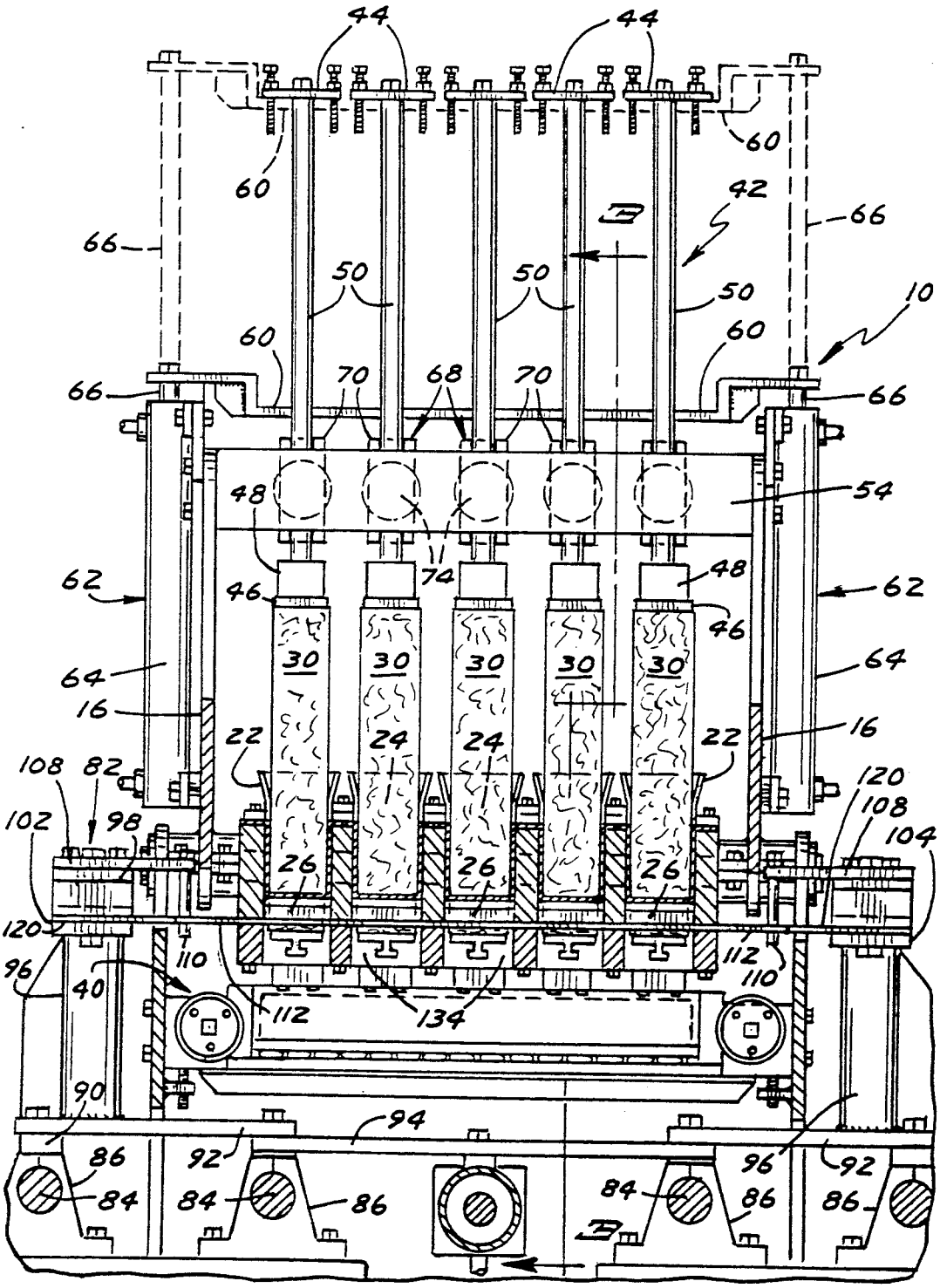
FIG. 2 is a sectional view taken in the direction of line 2—2 of FIG. 1.

Referring now to the drawings, it will be observed that our apparatus has been denoted generally by the reference numeral 10. The apparatus 10 comprises a frame 12 having legs 14 and upright laterally spaced side plates 16. The apparatus 10 further includes magazine assembly comprised of five tubular-shaped members 20, each having two side members 22, a back member 24, a front member 26, and an open bottom 28. All of the members 22, 24 and 26 are flared outwardly.

Contained in each member 20 is a block 30 of frozen fish. Each block 30 has a rectangular cross section. More specifically, the block 30 in each instance has an upper surface labeled 32, a lower surface 34 and a forwardly facing surface 36 that is engaged by a knife blade (to be referred to later), the knife blade first contacting the forward surface 36 as it moves in a path immediately adjacent to the open bottoms 28 of the tubular-shaped members 20. The height of each block 30 may vary somewhat; basically, though, the distance from the upper surface 32 to the lower surface 34 is on the order of ten inches. The distance measured from the forward surface 36 to the rear surface (not numbered) is on the order of 19 inches. The blocks 30 have a width on the order of 2½ inches. Thus, for the sake of the herein presented description, the blocks 30 have initial dimensions of 19"×10"×2½". It is the function of the yet to be referred to knife blade to cut or sever lower portions from the various frozen fish blocks 30 to produce various slabs indicated by the reference number 38 in each instance, each slab 38 being on the order of 19"×2½"×⅜". As the description progresses, it will be seen that the ⅜" thickness of the slabs 38 is a nominal figure in that the invention provides generally uniform slab thicknesses permitting an actual thickness to be chosen which does not result in an exceptionally thin slab 38 or "sliver" as the last slab 38 from a given block 30. It can be explained at this stage that the lower surface 34 of each block 30 rests on a vertically adjustable support table 40 which will be described in detail hereinafter.

Attention is directed at this time to a plurality of hold down plate assemblies indicated generally in each instance by the reference numeral 42. Each assembly 42 is comprised of an upper plate 44 and a lower plate 46 secured to the underside of a block 48. A pair of guide rods 50, 52 extend between the upper plate 44 and the lower plate 46. The guide rod 50 of each assembly 42 is located forwardly of the other guide rod 52. The lower plate 46 functions as a pressure or sole plate, being engageable with the upper surface 32 of the particular block 30 intended to be held in place. The guide rods 50 and 52 are constrained for vertical movement by reason of a forwardly disposed cross member 54 and a rearwardly disposed cross member 56, these cross members 54 and 56 having their laterally spaced ends attached to the previously mentioned side plates 16. Each cross member 54, 56 has a plurality of holes 58 formed therein so as to guide the various rods 50, 52 in a vertical path.

A transverse strip 60 underlies the various upper plates 44 of the hold down assemblies 42. Through the agency of a pair of air cylinders 62, there being one air cylinder 62 at one side and the other air cylinder 62 being at the other side of the apparatus 10, the assemblies 42 can be forcefully raised (but gravitationally lowered) Actually, the casing 64 of the air cylinder 62 at one side of the apparatus 10 is fixedly attached to the side plate 16 at that side, whereas the casing 64 of the other air cylinder 62 is fixedly attached to the other side plate 16. The air cylinders 62 have piston rods 66 that extend upwardly with their free upper ends being attached to the ends of the cross transverse strip 60 to raise the assemblies 42.

Figure 10:
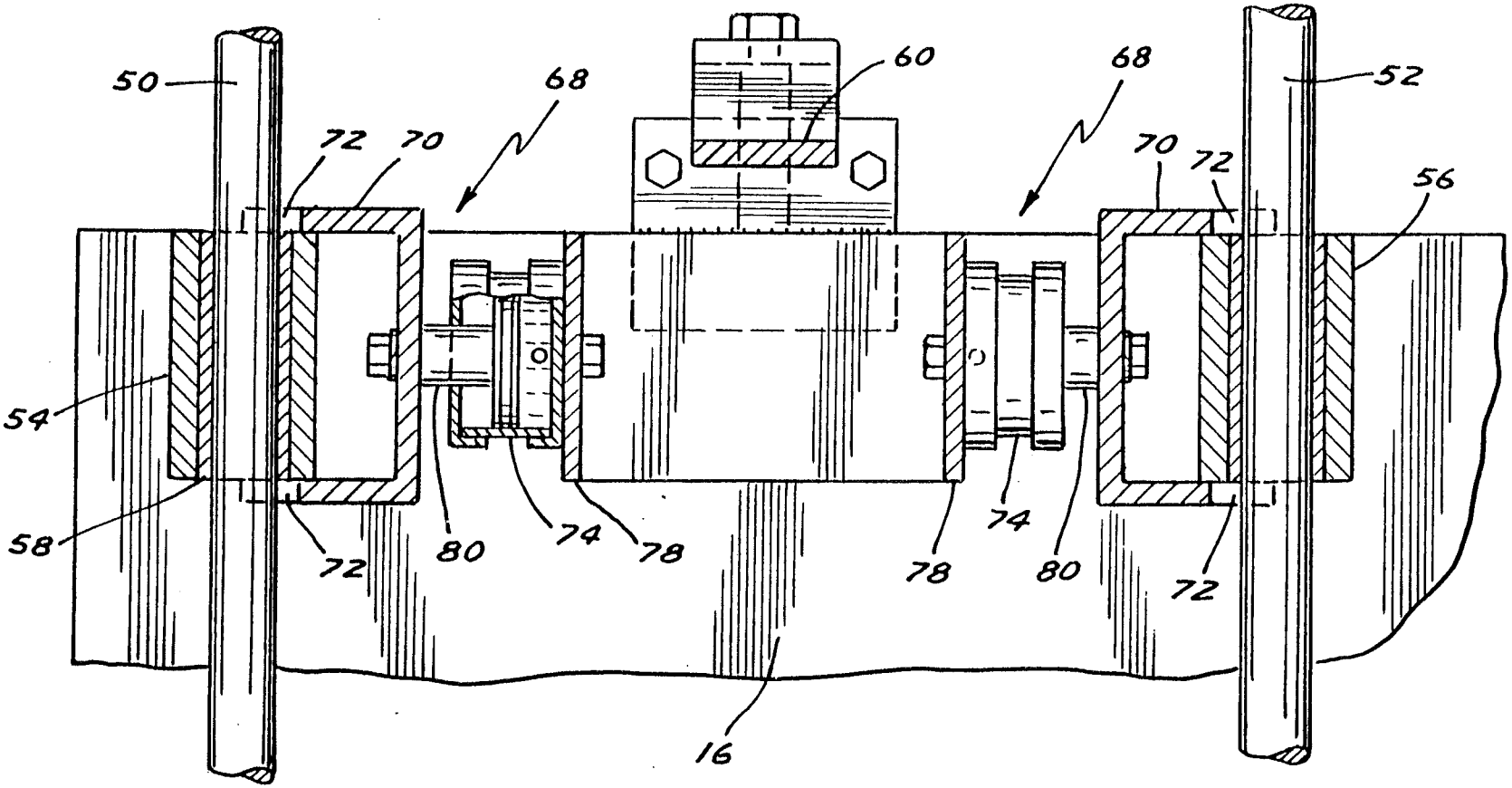
FIG. 10 is a sectional view taken in the direction of line 10—10 of FIG. 8.

As the description progresses, it will become apparent that the various hold down plate assemblies 42 should be clamped and held tight during portions of the operational sequence. Therefore, a clamping device 68 (see FIGS. 8 and 10) for each of the guide rods 50, 52 is provided. Each device 68 includes a jaw 70 having a V-shaped notch 72 formed therein. As just stated, there is a clamping device 68 for each guide rod 50, 52. A small air cylinder 74 is attached to a mounting strip 78, which mounting strip 78 extends between the laterally spaced side plates 16 of the frame 12. A relatively short piston rod 80 projects from each of the cylinders 74 and it is to the free or distal end of each piston rod 80 that a jaw 70 is attached.

Figure 5:
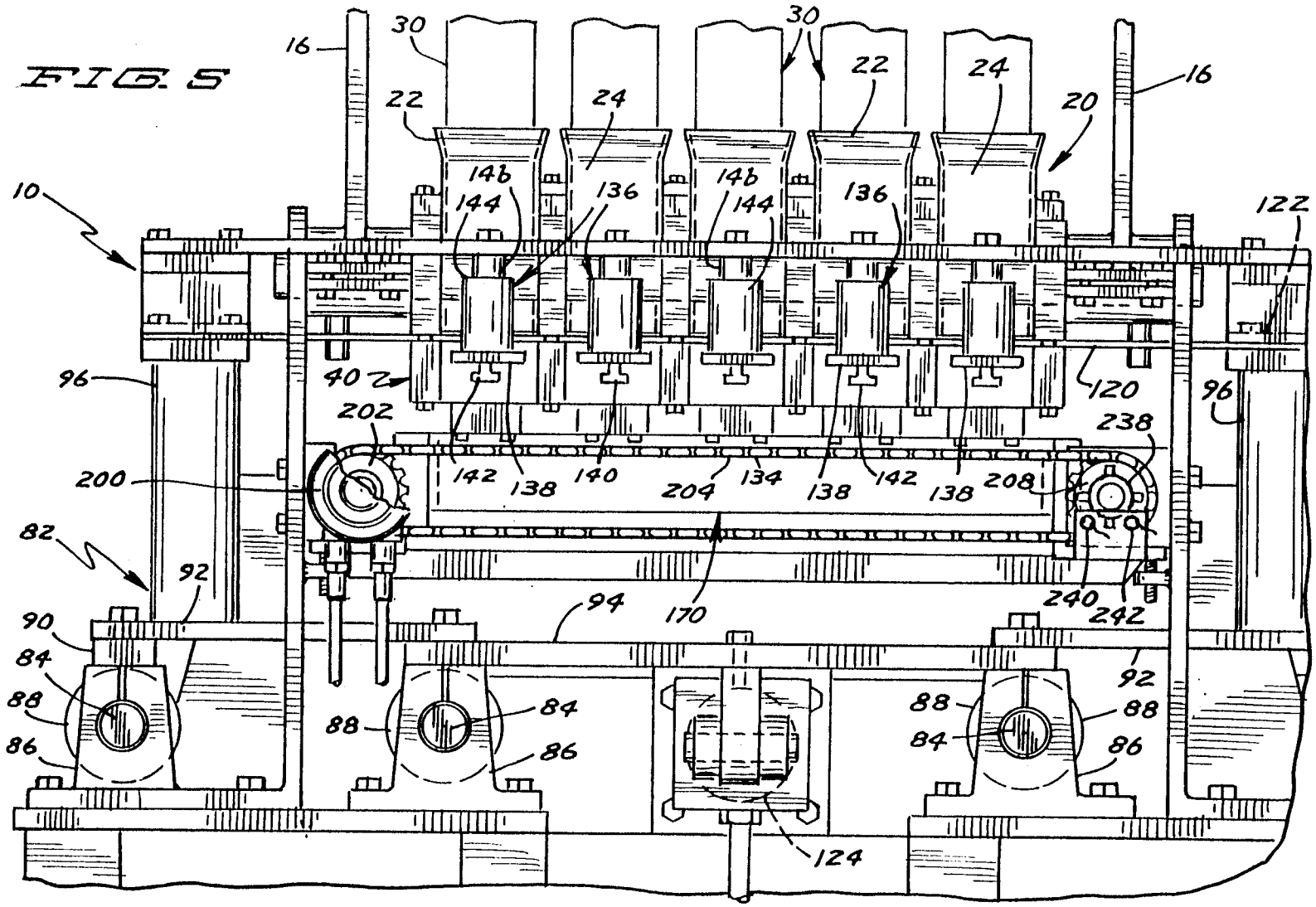
FIG. 5 is a sectional view taken in the direction of line 5—5 of FIG. 4.
Figure 5:
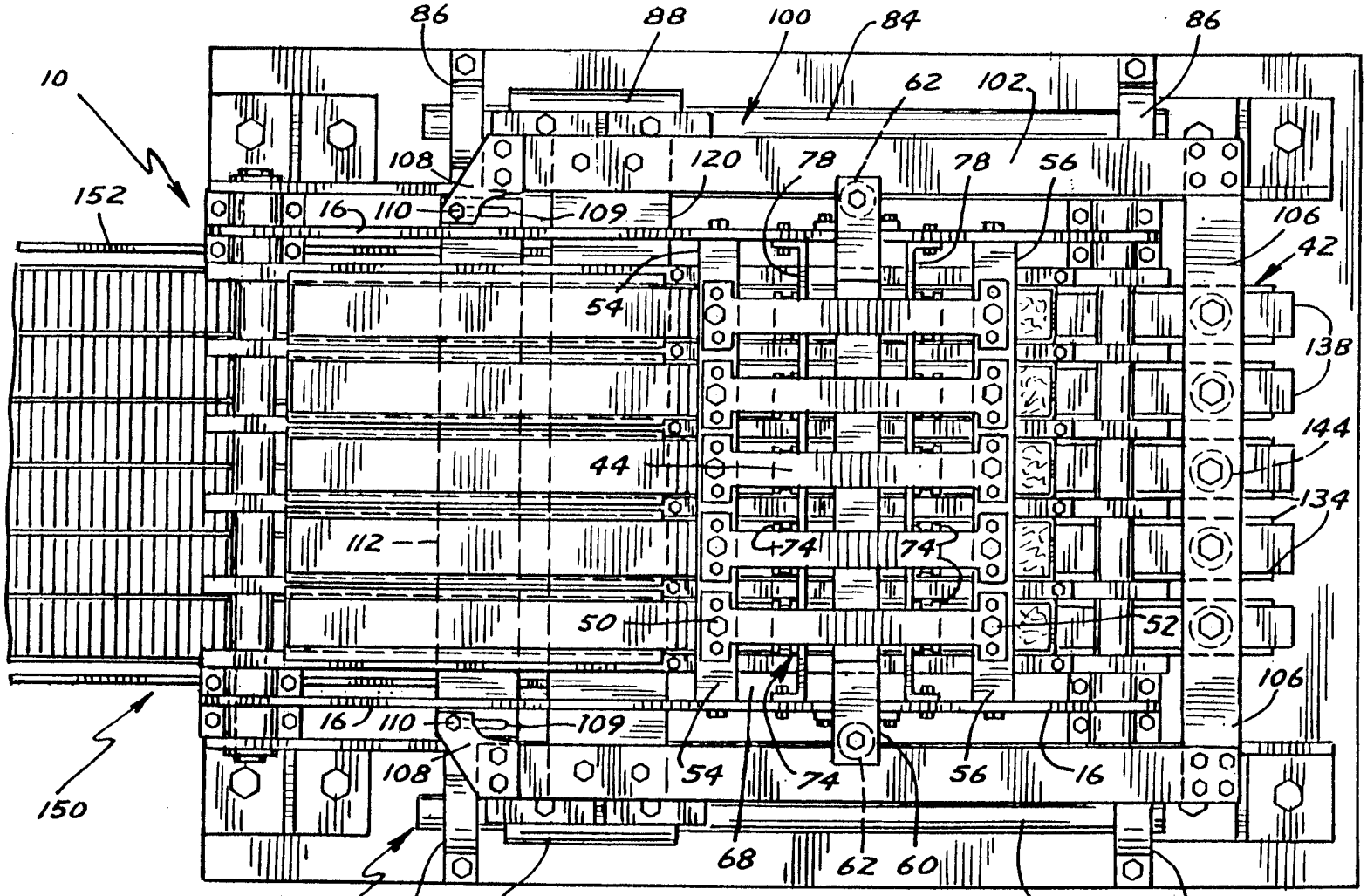

Referring now to a slide assembly denoted generally by the reference numeral 82, it will be perceived that the assembly 82 is rendered reciprocal by reason of four guide shafts 84 that are fixedly held in shaft supports 86, there being one such shaft support 86 at each end of the four fixedly held guide shafts 84. Encircling each of the guide shafts 84 is a cylindrical bearing housing 88, there being two bearing housings 88 at the left side of the apparatus 10 (as can be seen in FIG. 5) and two bearing housings 88 at the right side (although only one such housing appears in FIG. 5). Each bearing housing 88 has an upstanding lug 90 integral therewith and these lugs 90 have secured thereto relatively short plates 92. Here again, the relatively short plates 92 can be seen in FIG. 5, although one such plate 92 is visible in FIG. 1. From FIG. 5 it will be seen that there is a transversely extending intermediate plate 94. Although not yet referred to, the hydraulic cylinder that advances and retracts the slide assembly 82 is connected to the intermediate plate 94. Upstanding tubular supports or columns 96 have their lower ends anchored to the relatively short plates 92. As illustrated in FIG. 1, the two tubular supports or columns 96 appearing in this view have a U-shaped bracket 98 attached to the top or upper ends thereof.

Continuing with the description of the slide assembly 82, the slide assembly 82 additionally includes a rectangular unit 100 secured to the U-shaped brackets 98. In this regard, the rectangular unit 100 is comprised of a side strip 102 at one side and a second side strip 104 at the other side, a transverse rear strip 106 connected to the forward ends of the side strips 102 and 104, and inwardly directed webs 108 secured to the forward ends of the side strips 102, 104. Extending downwardly from each of the inner ends of the webs 108 is a drive pin 110, there being one such drive pin 110 for each web 108. The drive pins 110, there being one on each web 108 as just stated, extend downwardly through slots 109 at the ends of a follower plate or strip 112 for a purpose explained below (see FIG. 6).

A transversely extending knife blade 120 has its ends clamped between the upper surfaces of the brackets 98 and the lower surfaces of clamping plates 122 located just above each end of the knife blade 120, thereby assuring that the blade 120 will be held fast and thus movable in unison with the slide assembly 82. The severing action performed by the knife blade 120 will be presently described in detail. It will be understood that the blade 120 is advanced and retracted in unison with the slide assembly 82. However, when the slide assembly 82 moves, the drive pins 110 cause the strip 112 to follow the backside of the knife blade 120. It should be added that the slots 109 permit the follower plate 112 to remain stationary for a short period of time as the blade 120 moves. The purpose of the follower plate 112 is to support the trailing ends of the blocks 30 (actually the sections of the blocks 30 nearer the surface labeled 36), doing so as the blade 120 passes the vertical centerline of the blocks 30.

Figure 3:
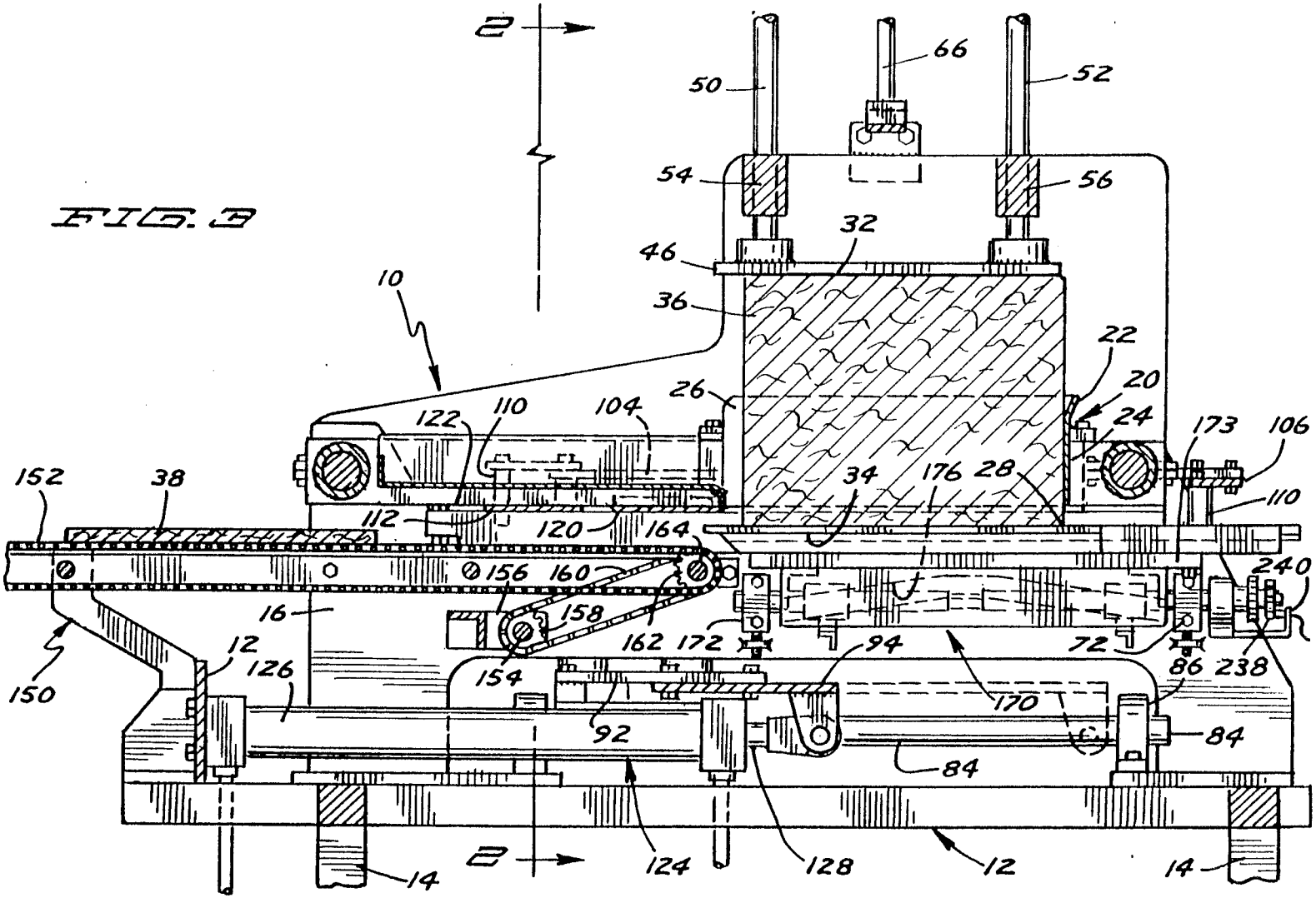
FIG. 3 is a sectional view taken in the direction of line 3—3 of FIG. 2.

Although the hydraulic cylinder that reciprocates the slide assembly 82 has been generally mentioned, it will now be pointed out that the cylinder has been identified by the reference numeral 124, having its closed end 126 connected or attached to the frame 12 (FIG. 3). The hydraulic cylinder 124 has a piston rod 128 that is attached to the intermediate plate 94. In this way, when the piston rod 128 of the cylinder 124 is forced outwardly by reason of fluid under pressure being introduced at the closed end 126 of the cylinder 124, the piston rod 128 advances the slide assembly 82 to cause the knife blade 120 to cut off the lower portion of each of the blocks 30, thereby forming the various slabs 38.

Figure 8:
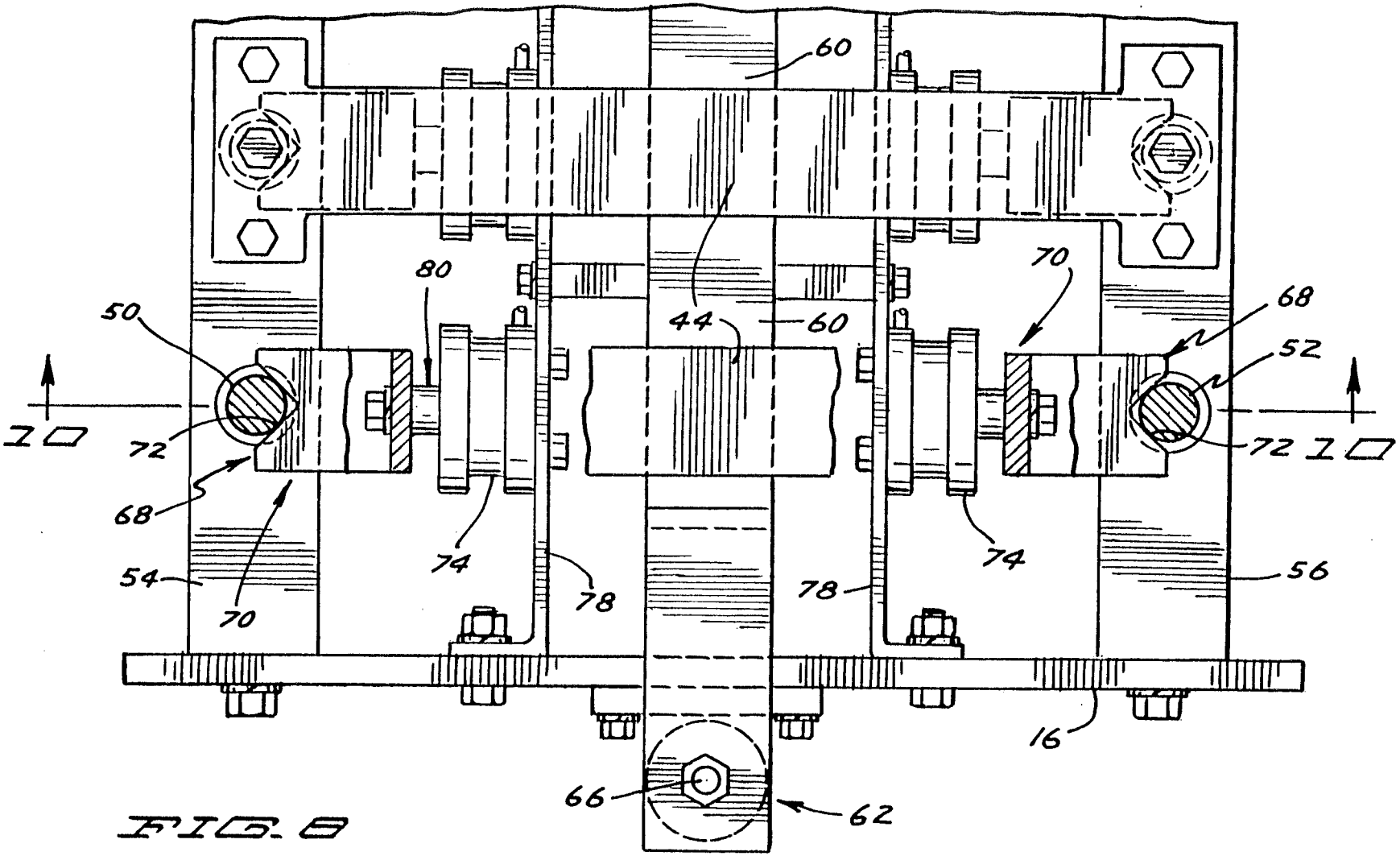
FIG. 8 is an enlarged plan view of the clamping devices only partially visible in FIG. 6.
Figure 9:
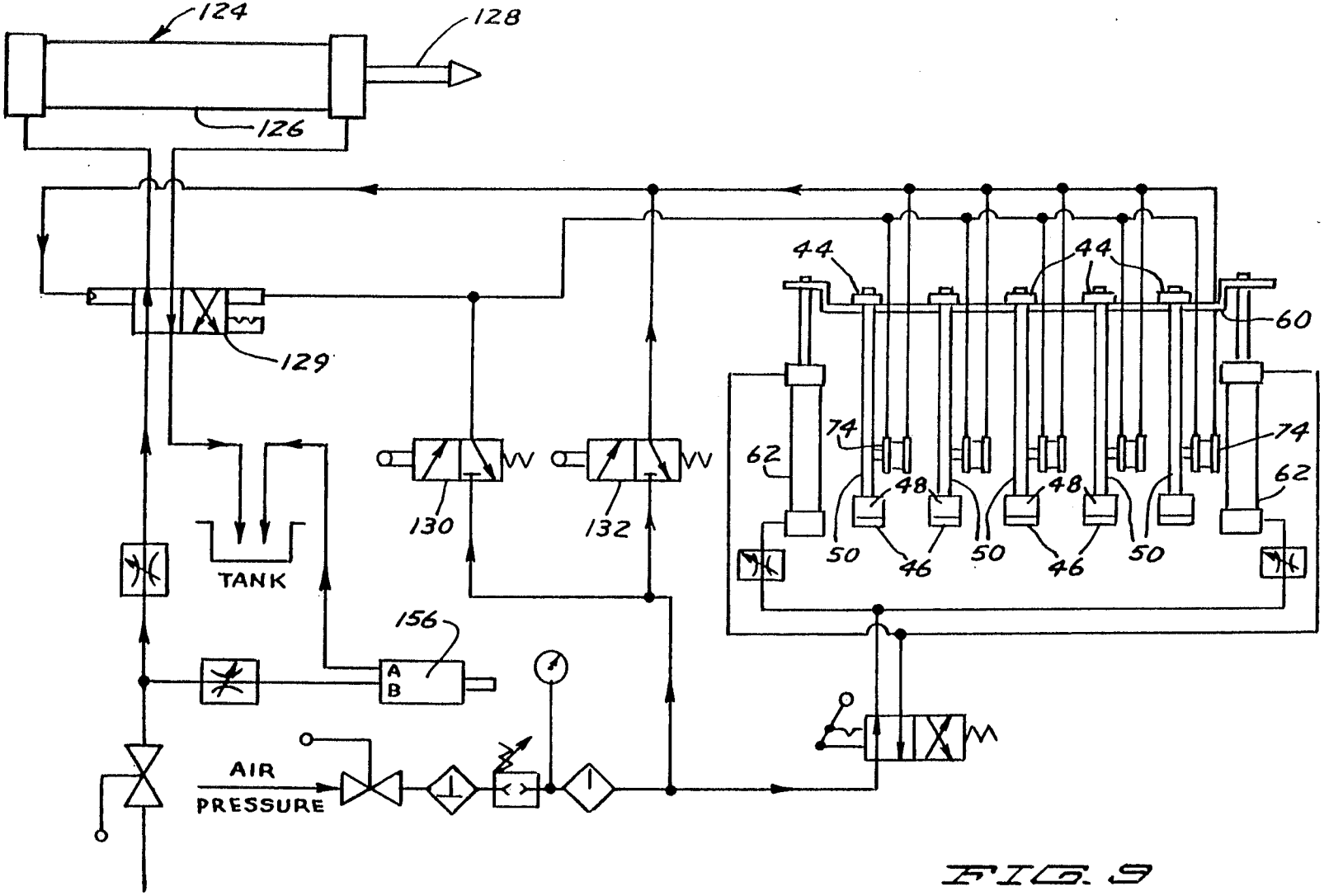
FIG. 9 is a piping diagram illustrating certain of the hydraulic and pneumatic components utilized in operating the apparatus.

When the cutting or severing stroke is completed, the slide assembly 82 actuates a pilot or cam valve 130 (best understood from FIG. 9) which is instrumental in effecting an unclamping of the various guide rods 50, 52 by shutting off the supply of air to the various air cylinders 74 of the clamping devices 68 (see FIG. 8). Concomitantly, the cam valve 130 pilots a hydraulic valve 129 causing hydraulic fluid to be supplied to the open end of the hydraulic cylinder 124 to force the piston rod 128 to the left as viewed in FIG. 3 to retract the blade 120 after it has completed a cutting stroke. Similarly a second pilot or cam valve 132 is actuated or engaged when the slide assembly 82 completes its retraction stroke, then causing the last-mentioned cam valve 132 to resupply air under pressure to the various air cylinders 74 which again clamp the various guide rods 50, 52. The clamping and unclamping of the guide rods 50, 52 will be better comprehended from the operational sequence that will be given later. However, it should be explained at this time that the cam valve 132 also pilots the hydraulic valve 129 thus supplying hydraulic fluid under pressure to the closed end 126 of the cylinder 124 to force the piston rod 128 to the right as viewed in FIG. 3 and thus begin another cutting stroke.

The vertically adjustable support table 40 has been only generally referred to. What will be termed a plurality of base slides 134 are secured to the upper surface of the support table 40. A plurality of pusher units 136 are provided, there being one for each channel-shaped member 20 of the magazine assembly 18, and each pusher unit 136 includes a strip 138 having a T-shaped guide 140 extending downwardly from the underside thereof. Each base slide 134 is formed with a complementarily shaped groove 142 so that the T-shaped guide 140 is tracked therein when the assembly 82 is advanced and retracted. It will be observed that the upper side of each of the strips 138 has an upstanding sleeve 144 affixed thereto. Each strip 138 is coupled to the rectangular unit 100 by means of a downwardly extending pin 146, the upper end of each pin 146 being secured to the underside of the rear transverse strip 106 of the rectangular unit 100. In this way, when the slide assembly 82 is advanced in the performance of a cutting or severing action, the pusher units 136 are also advanced in unison therewith. However, after the cutting or severing stroke has been completed, then the retraction of the slide assembly 82 causes the pusher units 136 to be retracted in unison therewith, the various strips 138 of the pusher units 136 engaging the slabs 38 that have been severed from the lower end portions of the frozen fish blocks 30. In other words, it is on the reverse stroke or return travel of the slide assembly 82 that the forward ends of the strips 138 of the various pusher units 136 shove what are now individual slabs 38, having at this stage been completely severed and detached from the various frozen fish blocks 30.

The pusher units 136 on the return stroke of the slide assembly 82 move the severed slabs 38 onto a conveyer indicated generally by the reference numeral 150. It is not believed necessary to describe the conveyer 150 in any great detail. However, from FIG. 4 it will be discerned that the conveyer 150 includes an endless wire mesh belt 152. There is a conveyer drive shaft 154 that is connected to a hydraulic motor 156 (also appearing in FIG. 4) the drive shaft 154 having a sprocket 158 thereon about which a chain 160 is entrained. The chain 160 also passes about a second sprocket 162 mounted on a driven shaft 164. In this way the now severed slabs 38 are moved to the right as viewed in FIG. 1 (to the left as viewed in FIGS. 4 and 6), being discharged from the conveyer 150 at a location (not shown) from which location they are taken to a portion-cutting apparatus (also not shown).

Figure 7:
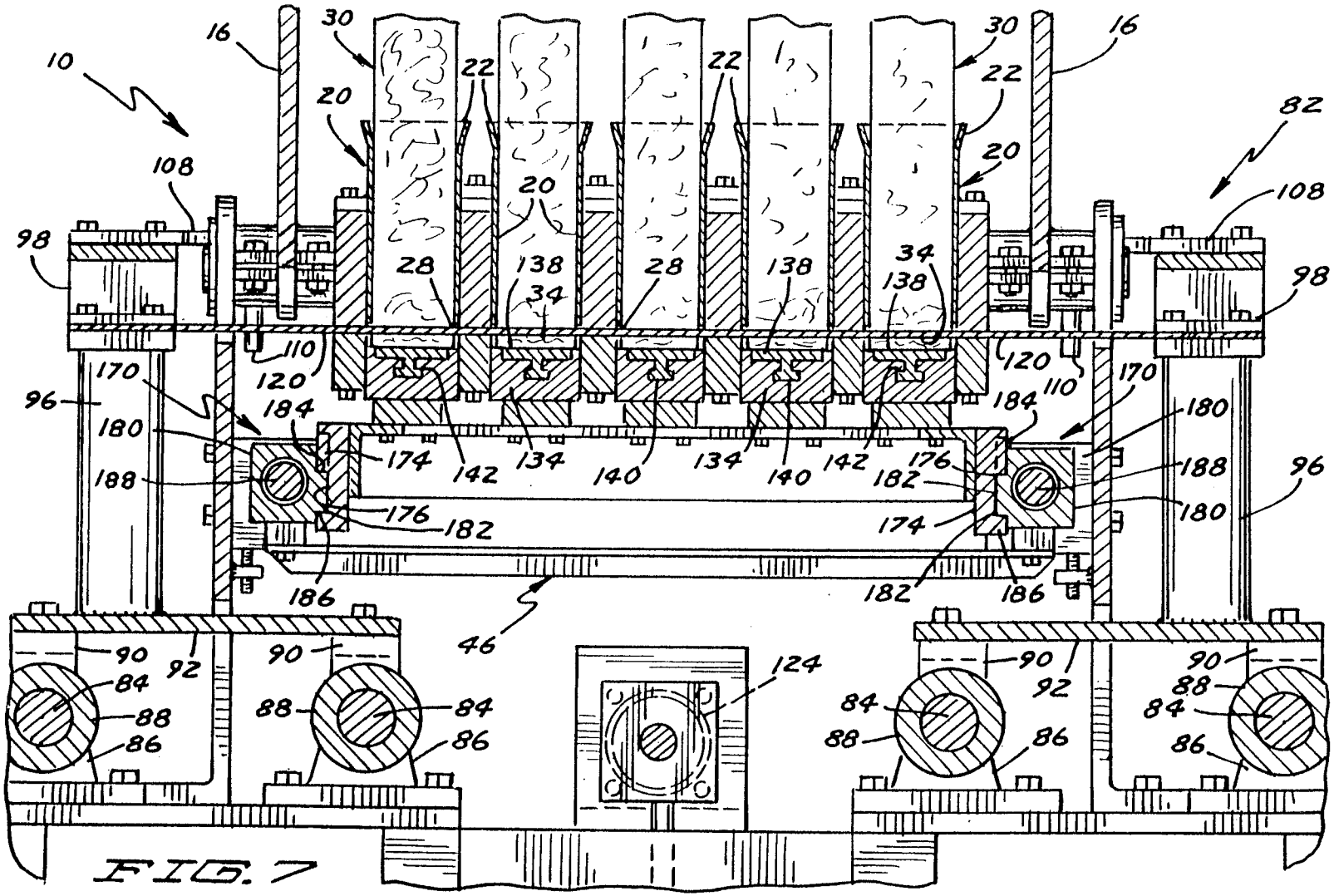
FIG. 7 is a sectional view taken in the direction of line 7—7 of FIG. 4.

At this point attention is directed to a mechanism 170 by which the table 40 is raised and lowered. It will help, it is thought, to understand that the raising and lowering mechanism 170 is similar to that described in U.S. Pat. No. 4,299,150, hereinbefore identified. It should be appreciated that there are two such mechanisms 170, one at each side of the apparatus 10. Each mechanism 170 includes a pair of bearing blocks 172 (FIGS. 4 and 6) that are secured to a portion of the frame 12. A track member 174 (FIG. 7), secured to a strip 173 fastened to the table 40, has an inclined track 176, the inclined track 176 constituting a groove formed in the inwardly facing side of each of the track members 174. There are two slide blocks 180 associated with each mechanism 170, each slide block 180 having a cam strip 182 formed thereon with upper and lower inclined edges 184 and 186, respectively. The cam strips 182 of the mechanisms 170 are slidably received in the tracks 176.

Figure 4:
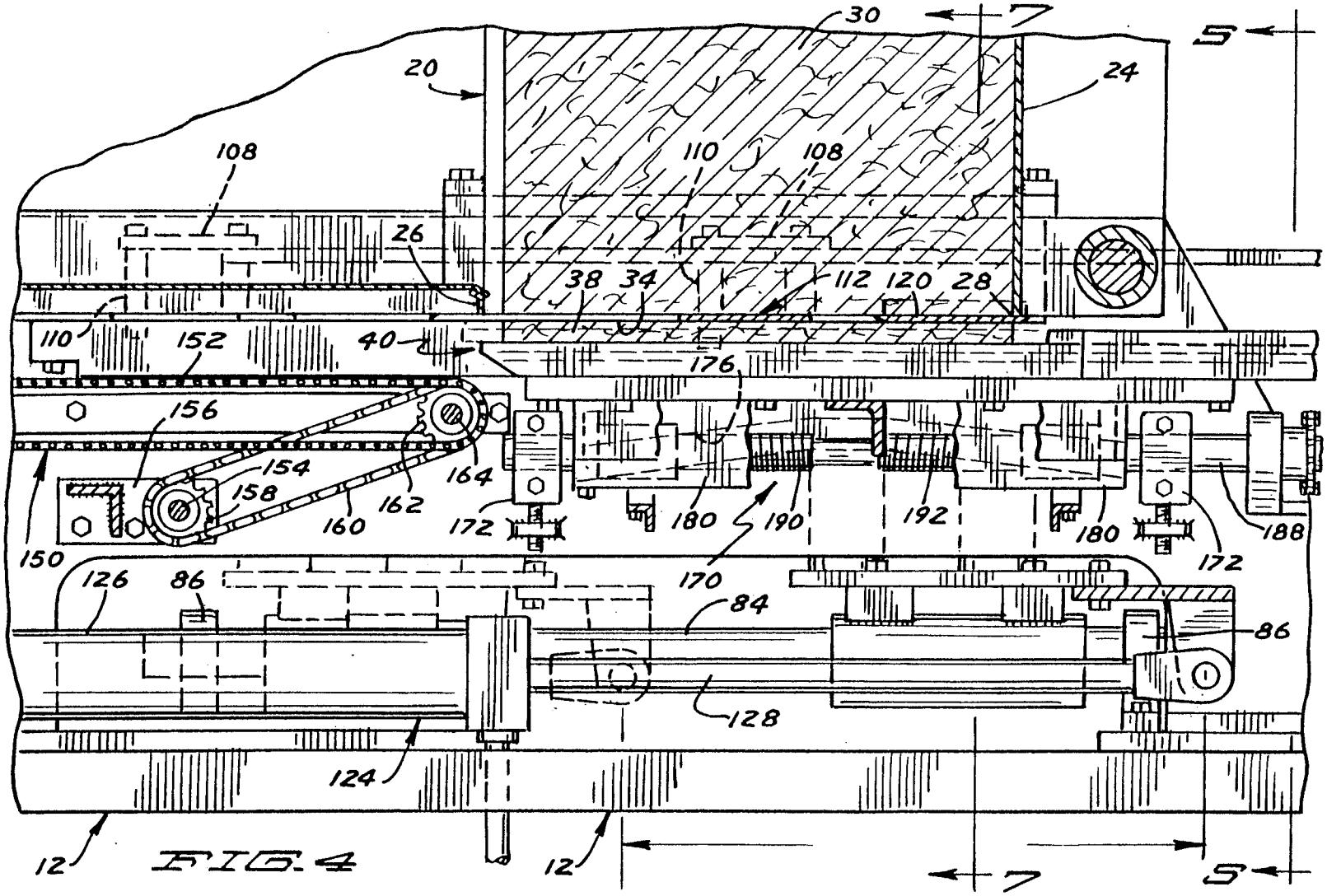
FIG. 4 is an enlarged elevational view taken from the opposite side of FIG. 1.

The slide blocks 180 at each side of the apparatus 10 rotatably journal a threaded shaft or lead screw 188 having oppositely pitched threaded sections 190 and 192, as can be seen in FIG. 4. Hence, when the lead screws 188 are rotated in one direction the slide blocks 180, more specifically their cam strips 182, cause the table 40 to be raised, and when the lead screws 188 are rotated in an opposite direction the table 40 to be lowered.

Whereas in Patent '150 the vertically adjustable table there disclosed is intended to be raised and lowered manually, the raising and lowering of the vertically adjustable table 40 in the present situation is motor driven, with the motor being manually controlled. Therefore, attention is directed at this point to a hydraulic motor 200 that rotates the two lead screws 188. By reason of a sprocket 202 and chain 204, a second sprocket 208 at the other side is rotated so as to rotate the lead screw 188 that is visible at the right in FIG. 5. As already explained, the function of the two lead screws 188 is to govern the height of the vertically adjustable table 40. This is accomplished via the hydraulic motor 200, that is, by reason of the controlled amount of hydraulic fluid delivered thereto.

With a suitable display, the operator can keep track of the vertical position of the table 40, and more importantly the thickness of the slab 38 that results from severing lower portions from the frozen blocks 30. The fractional number of revolutions through which the hydraulic motor 200 should rotate will be measured in increments of 1/16's of a revolution of the motor 200 for modifying the height of the adjustable table 40. It is planned that the hydraulic motor 200 be rotated in the proper direction by the operator controlling the direction and revolutions via an appropriate control valve.

Referring now to what will be called a quadrature position feedback feature, it can be perceived from FIG. 5 that a special 4-tooth sprocket 238 is attached to the end of the lead screw 188 appearing at the right in this particular figure. Associated with the 4-tooth sprocket 238 are two inductive proximity sensors 240 and 242 mounted 90° out-of-phase with respect to each other. Having the two sensors 240, 242 mounted out-of-phase in this manner provides an indication of how far the sprocket 238 has been rotated. The resolution of this position feedback is 1/16th of a turn with a maximum speed of approximately four revolutions per second, although a speed of half this rate would be completely satisfactory and actually preferable in some situations.

Quite briefly, a typical operational sequence involves the initial placing or loading of the frozen fish blocks 30 into the magazine assembly 18, there being one such block 30 positioned in each of the tubular-shaped members 20 of the magazine assembly 18. The operator then causes the air cylinders 62 to lower the various hold down plate assemblies 42, and hydraulic fluid is then introduced into the hydraulic cylinder 124 to initiate a cutting cycle. Immediately prior to the knife blade 120 beginning its forward travel or stroke, the hold down plate assemblies 42 are clamped through the agency of the various clamping devices 68, more specifically via their jaws 70 that are forced against the guide rods 50, 52 by the air cylinders 74.

As soon as the knife blade 120 reaches the end of its forward travel or stroke, the hold down plate assemblies 42 are unclamped by reason of the clamping jaws 70 of the clamping devices 68 being retracted due to the engagement of the slide assembly 82 with the pilot or cam valve 130 that releases the air pressure supplied to the various air cylinders 74. Then, the hold down plate assemblies 42 are free to follow the downward travel of the fish blocks 30 after the newly cut or severed slabs 38 have been ejected by the pusher units 136, the retraction of the slide assembly 82 causing the strips 138 to engage the rear end of each of the now-severed slabs 38 and to push such slabs 38 onto the conveyer 150.

We claim:

1. Apparatus for cutting a frozen food block into individual slabs comprising, in combination: means for supporting the lower end of the frozen food block at a first elevation; and a generally rectangular unit mounted for reciprocable movement at a second elevation above said first elevation, with the rectangular unit including first and second side strips located on opposite sides of the food block, blade means extending between and fixed to the first and second side strips, and pusher means also extending between and fixed to the first and second side strips in a forwardly spaced relation with said blade means, whereby when said unit is advanced linearly in one direction a lower slab portion is severed from said block and when said unit is retracted in an opposite linear direction said severed slab portion is pushed from beneath said block by said pusher means, motor means for adjusting said first elevation relative to said second elevation to vary the thickness of said severed slab, feedback means for indicating how far said motor means has adjusted said first elevation relative to said second elevation, wherein said feedback means includes a 4-tooth sprocket and two inductive proximity sensors mounted 90° out-of-phase with respect to each other.

2. The apparatus of claim 1 further comprising, in combination: means for clamping said block against the supporting means while said blade means is cutting a slab therefrom.

3. The apparatus of claim 1 further comprising, in combination: a follower plate; and means attached to the first and second side strips for carrying the follower plate on the side of the blade means opposite the pusher means with the follower plate remaining stationary for a short period of time when the unit is initially advanced and when the unit is initially retracted.

4. The apparatus of claim 3 wherein the carrying means comprises, in combination: first and second slots located in one of the follower plate and the first and second side strips; and first and second drive pins extending into the first and second slots and extending from the other of the follower plate and the first and second side strips.

5. Apparatus for cutting a frozen food block into individual slabs comprising a table, means for vertically adjusting said table, blade means reciprocable in a horizontal plane above said table, means for actuating said blade means to cut slabs successively from said frozen food block, means for removing the cut slabs, and means for clamping said frozen food block against the table while said slabs are being cut, wherein the frozen food block includes an upper surface and said clamping means includes upper and lower plates, a pressure plate secured to the underside of said lower plate engageable with the upper surface of said block, a pair of guide rods extending between said upper and lower plates, means constraining said guide rods for vertical movement, a jaw for each of said guide rods, and an air cylinder for actuating each of said jaws into engagement with said guide rods to effect a clamping of said frozen food block while said slabs are being cut.

6. Apparatus for cutting a frozen food block into individual slabs comprising, in combination: means for supporting the lower end of the frozen food block at a first elevation; and a generally rectangular unit mounted for reciprocable movement at a second elevation above said first elevation, with the rectangular unit including first and second side strips located on opposite sides of the food block, blade means extending between and fixed to the first and second side strips, and pusher means also extending between and fixed to the first and second side strips in a forwardly spaced relation with said blade means, whereby when said unit is advanced linearly in one direction a lower slab portion is severed from said block and when said unit is retracted in an opposite linear direction said severed slab portion is pushed from beneath said block by said pusher means, motor means for adjusting said first elevation relative to said second elevation to vary the thickness of said severed slab, feedback means for indicating how far said motor means has adjusted said first elevation relative to said second elevation, wherein said feedback means includes a sprocket having at least a first tooth, and means for sensing the position of the tooth.

* * * * *